United States Patent [19]

Ryham

[11] Patent Number: 4,888,882

[45] Date of Patent: Dec. 26, 1989

[54] METHOD AND APPARATUS FOR DRYING A PARTICULATE MATERIAL SUCH AS BARK

[76] Inventor: Rolf Ryham, 17 Heath Ct., Princeton, N.J. 08540

[21] Appl. No.: 326,543

[22] PCT Filed: Aug. 27, 1987

[86] PCT No.: PCT/SE87/00378

§ 371 Date: Mar. 1, 1989

§ 102(e) Date: Mar. 1, 1989

[87] PCT Pub. No.: WO88/01717

PCT Pub. Date: Mar. 10, 1988

[51] Int. Cl.[4] ..... F26B 3/10

[52] U.S. Cl. ..... 34/10; 34/57 R; 34/57 A; 34/130

[58] Field of Search ..... 34/10, 57 R, 57 A, 109, 34/130, 131, 132

[56] References Cited

U.S. PATENT DOCUMENTS 3,079,222 2/1963 Reeve ..... 34/57 A 4,521,378 6/1985 Ichimura et al. ..... 34/57 A

*Primary Examiner*—Henry A. Bennett
*Assistant Examiner*—John M. Sollecito
*Attorney, Agent, or Firm*—Cohen, Pontani & Lieberman

[57] ABSTRACT

In a method and apparatus for drying a particulate material, for instance bark, the material is disposed as an annular bed (11) on a perforated disc (10). The bed is moved along the disc by being rotated about its axis by pushing members (12). A surface layer of moist material is continuously deposited on the upper surface of the bed in an area extending over the entire width of the bed, while at the same time a corresponding surface layer of dried material is continuously removed from the lower surface of the bed in a substantially corresponding area (17), so that the bed thickness is substantially maintained uniform over the entire area of the bed. A uniform moisture content is imparted to a drying medium which is passed through the support disc and the bed, the medium is preferably saturated with moisture before leaving the bed.

11 Claims, 2 Drawing Sheets

METHOD AND APPARATUS FOR DRYING A PARTICULATE MATERIAL SUCH AS BARK

TECHNICAL FIELD

The invention relates to a method and an apparatus for drying a particulate material such as bark, and particularly to a method and apparatus including a substantially horizontal support for carrying a bed of such material, means for passing a drying medium upwards through the support and the bed, and means for feeding new material to and discharging dried material from the bed.

BACKGROUND ART

Material is traditionally dried by a drying medium in the form of a gas, the supply temperature of which it is attempted to be kept high in order to minimize the costs for the drying apparatus itself, i.e. chiefly the size of the apparatus. In such a case the drying medium will depart from the apparatus at a relatively high temperature, and above all in a moisture-unsaturated state, which means that it is seldom possible to achieve the optimum energy utilisation.

In order to achieve the greatest possible contact area between material and drying medium the material is often dried in a suspension of said material and said drying medium. This often results in large investments for separating the drying medium and the dried material. Favourable moisture content and temperature gradients between drying medium and material can seldom be reached in suspension drying, due to an uncontrolled mixing of the material. A drying technique of the type just mentioned is described e.g. in the Swedish patent application Nos. 7810558-2 and 8307170-4.

Another known method of drying bark comprises spreading out a layer of moist bark to form a bed on a gas permeable support and passing a drying medium upwards through said support and said bed, as well as linearly moving the bed over the support through which drying medium is blown, new bark being supplied to the bed at its rear end and dried material being removed at its front end. Problems will then occur, since the bed at its front "dried" end has a certain moisture gradient or profile, which means that the moisture content of the removed material is some kind of a mean profile value. Additionally, since the flow resistance of the bed often declines with dropping moisture content therein, the drying medium rather will tend to flow through the relatively dry front or forward part of the bed, the result being that the drying process "gallops" at the front end part of the bed. In turn, this results in a number of drawbacks, e.g. a low moisture content in a large proportion of the drying medium departing from the bed, bringing the requirement for large apparatuses and large energy consumptions for heating and/or dehumidifying the drying medium, if it is to be recirculated through the bed. Furthermore, it is difficult to regulate drying such that removed bed material has the optimum moistness. The temperature and moisture gradients between drying medium and material will also not be the optimum one.

As other prior art which shows other feeding and removal techniques per se reference can be made to FI 66485 which describes an apparatus that works with an endless wire to discharge the material to be dried. From the figure it can be gathered that a thin layer is removed from the bottom of the bed by the means 13 and 14 which are operated in a noncontinuous manner. To operate such a process continuously it should most probably be necessary to remove layers that are very thin which might be possible for very homogeneous materials like cereals or similar but not for bark or similar materials.

Accordingly, one object of the invention is to provide a technique by which the material, arranged as a bed, is dried in conditions such that the drying medium departing from or leaving the bed has a substantially constant or uniform moisture content and is preferably saturated with moisture, while at the same time material with a desired degree of dryness can be taken from the bed.

SUMMARY OF THE INVENTION

The method according to the invention of drying a particulate material, e.g. bark, is a method of the type where a bed of said material is arranged on a drying mediumpermeable support, a drying medium is driven upwards through said support and said bed, and during the drying operation dried material is discharged from and new material is fed to said bed, and is characterized in that the bed is arranged as an annular bed on a stationary support, the bed is moved in its circumferential direction on the stationary support, dried material is removed from the lower surface of the bed through said support while the bed is moving and new material is deposited on the upper surface of the bed while essentially maintaining a uniform bed thickness, and the drying medium is passed through the bed in conditions such that when leaving the bed said drying medium has a substantially uniform moisture content in essentially all part areas of the bed, permeated by said drying medium.

The method is preferably carried out in such a way that the drying medium is in a substantially saturated state when departing from the bed.

The take-up of moisture of the drying medium originates substantially solely from the moisture of the bed material.

Preferably the drying medium is passed through the whole area of the bed.

By removing a layer of dried material from the lower surface of the bed the advantage is achieved that the layer of the bed which is thereabove can be moist, so that the drying medium can reach a uniform moisture content on departure from the bed, and can especially be moisture saturated. This means that the flow of drying medium can be minimised and that optimum moisture and temperature gradients between material and medium are obtained. Since the drying medium departing from the bed has a uniform moisture content, and is preferably saturated, the medium can be effectively dehumidified by an optimum dehumidifying apparatus and be reheated for recirculation through the bed. A heat pump may then be utilised in a manner known per se for dehumidifying and reheating the medium. When recirculating the drying medium, whether or not it consists of steam or any gas, heat exchanger(s) (heater(s)) can be utilised in the recirculation duct, the heat exchanger(s) heating the gas to the desired temperature or superheating part of the steam flow departing from the bed (any excess of saturated steam after the bed is discharged as a practically dry, saturated steam).

When depositing material on and removing material from the bed the means used therefore is displaced or moved relative to the bed. Said depositing and removal means extend over the entire width dimension of the bed, so that material is deposited or removed, respectively, over the width of the entire bed in the longitudinal displacement of the bed relative to said means.

During operation the bed has a moisture profile that varies along the displacement direction of the bed. Generally the bed has a uniform thickness over its entire area. The drying medium through-flow resistance of the bed depends on the moisture profile of the bed, the higher the moisture content in the bed the greater the flow resistance. In addition thereto, a thick moist bed layer can saturate a greater drying medium flow with moisture than a relatively thin, moist bed layer. In accordance with the invention it can therefore be advantageous, particularly with greater drying medium flows through the bed, to arrange the drying medium flow proportionally greater in the part areas of the bed where the bed has a relatively higher moisture content. In this way the bed volume of the apparatus can be utilised optimally with respect to the achievement of a uniform moisture content in the drying medium, which departs from all the part areas of the main surface of the bed. Since the gas flow resistance of the bed is dependent on the thickness thereof, the bed thickness should be kept uniform. This can be achieved by having material removed and deposited at substantially a single position, although at opposite main surfaces of the bed. As mentioned the bed is annular and is displaced in its circumferential direction on a fixed, horizontal support or carrier, e.g. a perforated disc, by means of driving or forwarding means. Deposition of material can be accomplished using a radially extending, stationary screw feeder which, apart from supplying new material over substantially the entire width of the bed, also "ploughs off" the upper surface of the bed, thus maintaining a uniform bed thickness. The screw feeder is preferably arranged to maintain a material through-flow. Material discharge or removal can be obtained by using an opening or a slit extending across the width of the support to define the inlet of a discharge chute, in which a discharging screw conveyor can be disposed. To ensure that a uniformly thick bottom layer is removed from the annular bed, the screw of the discharge conveyor may have a pitch that can be varied to suit the different material flows to be taken out at different bed radii. Alternatively, for different radial bed sections there may be different discharge chutes with associated screw conveyors of different capacities for achieving the situation that a uniformly thick bed layer is discharged over the entire bottom side of the annular bed. The bas-permeable support is preferably horizontal.

An apparatus for carrying out the method claimed includes a gaspermeable support on which a uniformly thick particulate material bed is supported, means for displacing the bed along the support, means for passing a drying medium up through said support and said bed, means for removing a uniformly dried layer from the bottom side of the bed, and means for depositing new material on the upper surface of the bed so as to deposit on the bed an amount of material which corresponds to the amount of dried material removed, while maintaining a substantially uniform layer thickness.

Preferably, the apparatus also includes a housing, which defines a circulation flow path for the drying medium. In said flow path there are suitably fans for driving the medium through the bed, and heating means for reheating the medium as well as dehumidification means for dehumidifying the drying medium before the recirculation thereof. Reheating and dehumidifying the drying medium can be achieved in any conventional manner by a heat pump, the vaporiser of which dehumidifies the drying medium by cooling the same so that the condensate can be removed, while the thus dehumidified gas is reheated at the heat pump condenser. Alternatively, the drying medium can be passed through a socalled ADIAC absorber, in which the drying gas is simultaneously dehumidified and heated (see Swedish Pat. No. 7902979-9).

The invention, as well as preferable embodiments thereof, are defined in the accompanying claims.

An embodiment of the invention will now be described in more detail with reference to the accompanying drawings.

EMBODIMENT SHOWN IN DRAWINGS

Figure 1:
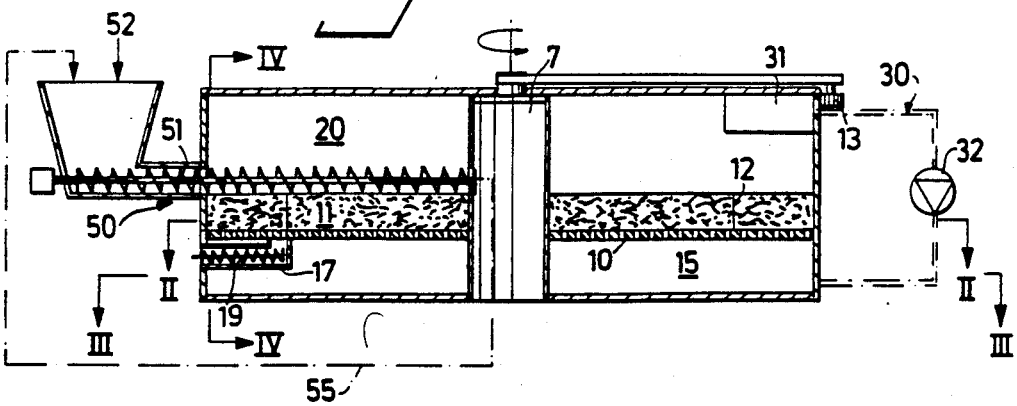
FIG. 1 schematically illustrates a vertical section through drying apparatus in accordance with the invention.

In FIG. 1 there is shown a generally circular-cylindrical apparatus in accordance with the invention and intended for the drying of bark. The apparatus includes a generally annular housing the outer diameter of which may approach about 20 meters. In the housing there is a gas permeable support in the form of an annular, horizontal, perforated plate or disc 10, which carries a uniformly thick bed 11 of bark. Said perforated disc 10 is stationary, and the bed 11 is brought to a rotational movement by the pusher paddles 12 depicted in FIG. 2. These pusher means 12 are driven by drive means 13 to give a rotational speed of for instance one revolution per three hours for bark. Below the perforated disc 10 in the housing there is a distribution chamber 15 for the drying medium. Furthermore, above the bed 11 there is in the housing a collection chamber 20 for drying medium that has passed through the bed 11. There is also a schematically illustrated recirculation duct 30 that brings the chambers 15,20 into mutual communication with each other. A unit 31 is arranged inside the duct 30 for dehumidifying and heating the drying medium. Additionally there is a fan 32 for recirculating the drying medium.

Figure 4:
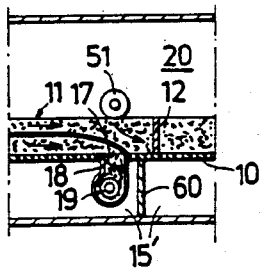
FIG. 4 is a schematic section taken along the lines IV—IV in FIG. 1 and illustrates means for supplying material to and discharging material from the bed.

The thickness of the bed 11 may be between 200 and 2000 mm. Since the drying medium is passed upwards through the bed 11, the friction between the bed 11 and the support 10 will be low. Material depositing means 50 in the form of a screw feeder 51 is illustrated in FIG. 4, which screw extends radially from an external radially situated supply hopper 52 and opens at the central, vertical through space 7 in the drying apparatus. With the aid of a schematically illustrated conveyor 55 bark material is recirculated to the hopper 52; the material is conveyed in excess by the screw 51 through the apparatus housing, inter alia to maintain in a simple way a uniform bed thickness therein.

Figure 2:
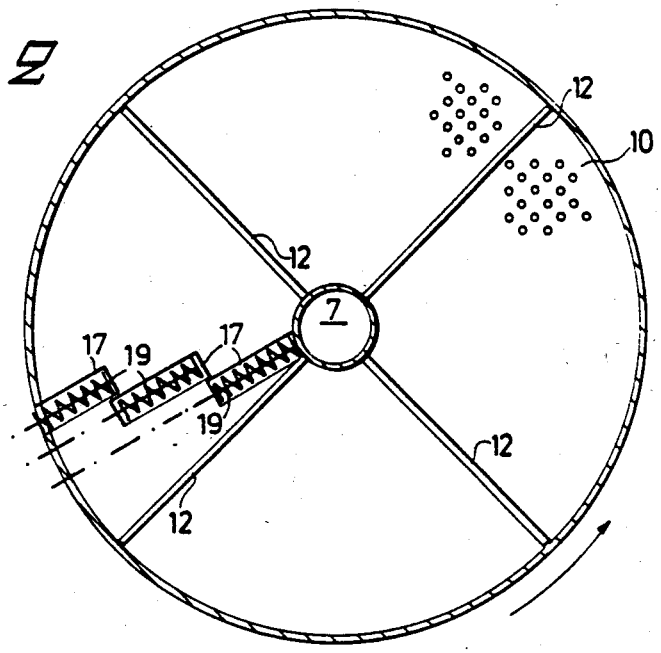
FIG. 2 is a section along the line II—II in FIG. 1.

Dried material is removed from the bottom side of the bed via one or more generally radially extending removal slits 17 in the support 10, which slits 17 form input openings to a chute 18, from which falling dried material is removed by discharging means such as screws 19. Three screws of different capacities are illustrated in FIG. 2 for the removal of a material layer of the same thickness over the width of the entire bed, but it should be clear that there could be only one radially extending slit 17 for a corresponding chute 18, in which there is a screw conveyor, the pitch of which varies along the length thereof so that the discharged layer will have a uniform thickness across the width of the bed. As will be seen from FIG. 4, the discharge means 17.18.19 and the material depositing means 50 should be situated directly opposite each other at either side of the bed so as to substantially maintain the thickness of the bed.

Figure 3:
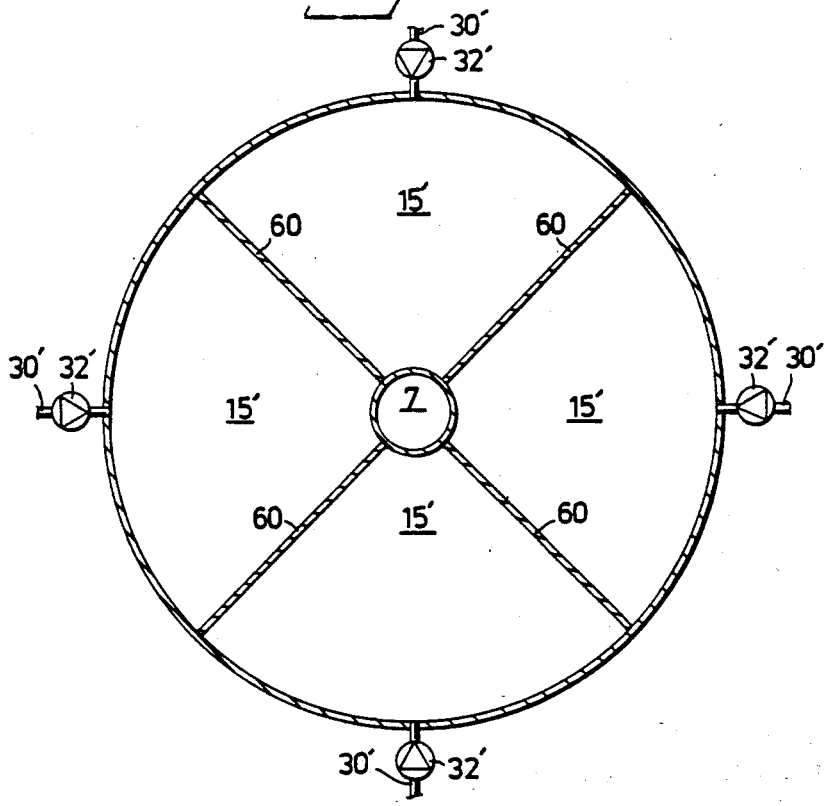
FIG. 3 illustrates an arrangement for varying the air flow through different sections of the main surface of the bed in its direction of movement.

The distribution chamber 15 is schematically illustrated in FIG. 3 as being divided by partitions 60 into a plurality of chamber sectors or segments 15' separated from each other in the circumferential direction of the housing. One partition 60 is situated in the same circumferential position as the material depositing means and the material removal means. Each of the chamber segments 15' is assigned its own fan 32' for the drying medium. The different fans 32' are adjustable to give different flows. Briefly while referring to FIG. 4 it can be seen that in the rotational direction of the pusher means 12 the bed has substantially greater moistness immediately after the depositing means 50 than immediately before the same. By dividing the distribution chamber 15 in a number of sectors, which are separated in the circumferential direction of the bed, and assigning each such sector its own drying medium fan 32', it can be ensured that even for great drying medium flows the medium departing from the bed has a uniform moisture content in all part areas of the bed, by corresponding flow adjustments of the fans 32' assigned to the respective chamber sectors 15'. By means of the individually controllable fans 32' a drying medium throughflow can be provided in the different circumferential sections of the bed such that the medium will obtain a predetermined moisture content on departure from the bed in all the part areas of the bed through which gas flows, these being simultaneously achieved as compensation for varying drying medium through-flow resistances in the circumferential direction of the bed, which depend on the moisture content of the bed.

What is claimed is:

1. A method of drying a particulate material, especially bark, comprising:

arranging an annular bed of said material on an annular drying medium-permeable stationary support;

passing a drying medium upwards through said support and said bed;

moving said bed in the circumferential direction thereof on said stationary support;

removing dried material from the lower surface of the bed through said support while the bed is moving and depositing new material on the upper surface of the bed while essentially maintaining a uniform bed thickness; and passing said drying medium through said bed such that when leaving said bed said drying medium has a substantially uniform moisture content in essentially all part areas of said bed permeated by said drying medium.

2. The method as claimed in claim 1, wherein said drying medium is brought to an essentially moisture-saturated condition before leaving said bed.

3. The method as claimed in claim 1, additionally comprising the step of varying the drying medium-pressure difference over different part areas of said bed to compensate for varying moisture-content dependent through-flow resistance of said bed.

4. The method as claimed in claim 1, additionally comprising the steps of displacing a material removal means and a material depositing means relative to said bed; and operating said removal and depositing means to remove and deposit material, respectively, in similar flows at corresponding positions so as to essentially maintain the thickness of said bed.

5. The method as claimed in claim 4, wherein said removal means is provided with at least one inlet gap stationarily disposed in said support.

6. The method as claimed in claim 1, wherein said drying medium is passed through substantially the entire area of said support and said bed; and said drying medium is preferably recirculated through said bed after a dehumidification and heating operation.

7. The method as claimed in claim 1, wherein said drying medium is a gas which is dehumidified and reheated before being recirculated.

8. The method as claimed in claim 7, wherein said gas is dehumidified and reheated by means of a heat pump.

9. The method as claimed in claim 1, wherein said drying medium is steam which is passed into said bed in a superheated state.

10. An apparatus for drying a particulate material, especially bark, comprising:

a substantially horizontal support for carrying a bed of said material, said support and said bed having a substantial annular configuration;

means movable over said support for moving said bed in a circular direction on said support;

means for passing a drying medium upwards through said support and said bed and for bringing said drying medium to a substantially uniform moisture content when leaving said bed in all part areas of said bed which are permeated by said drying medium;

means for discharging dried material from said bed, said means comprising at least one inlet opening in said support, which opening extends transversely to the direction of movement of said bed for removing a uniformly thick, dried material layer from the lower surface of said bed when said bed is moving in circular direction; and means for feeding new material to said bed and for depositing said new material on top of said bed to compensate for said removal of said dried material so as to essentially maintain the bed thickness.

11. The apparatus as claimed in claim 10, additionally comprising a drying medium distribution chamber below said support, said chamber being divided into a number of chamber sections which are separated from each other in the direction of the movement of said removal means relative to said bed; and an individually controlled drying medium fan at each said chamber section.

* * * * *